United States Patent [19]

Stancill

[11] 4,421,314

[45] Dec. 20, 1983

[54] BOARD GAME APPARATUS

[76] Inventor: Roger Stancill, 4019 Byrd Rd., Kensington, Md. 20895

[21] Appl. No.: 392,631

[22] Filed: Jun. 28, 1982

[51] Int. Cl.[3] ..... A63F 3/00

[52] U.S. Cl. ..... 273/249; 273/243; 273/285

[58] Field of Search ..... 273/249, 274, 261, 258, 273/275, 261, 258, 287, 262, 260, 255, 256, 257

[56] References Cited

U.S. PATENT DOCUMENTS

| | | | |
|---|---|---|---|
| D. 240,951 | 8/1976 | St. Cyr et al. | D21/30 |
| 846,509 | 3/1907 | Richter | 273/249 |
| 2,722,425 | 11/1955 | Gazelle | 273/248 |
| 3,901,512 | 8/1975 | Fekete | 273/249 |
| 4,047,719 | 9/1977 | Sajkovic | 273/287 |
| 4,119,321 | 10/1978 | Creel | 273/248 |
| 4,124,213 | 11/1978 | Kaplowitz | 273/248 |
| 4,129,304 | 12/1978 | Mager | 273/243 |
| 4,248,437 | 2/1981 | Lemberger et al. | 273/243 |
| 4,286,787 | 9/1981 | Barber | 273/248 |

FOREIGN PATENT DOCUMENTS

| | | | |
|---|---|---|---|
| 650529 | 3/1949 | United Kingdom | 273/261 |

*Primary Examiner*—Richard C. Pinkham
*Assistant Examiner*—Matthew Schneider
*Attorney, Agent, or Firm*—Donald A. Kettlestrings

[57] ABSTRACT

Game apparatus having a game board defining a triangular playing surface with a predetermined number of triangular areas formed on the playing surface. A plurality of overlapping hexagons are defined by the triangular areas, each of the hexagons being formed by six of the triangular areas positioned to have a common apex. Predetermined ones of the triangular areas are marked with a number from one through six, and plural sets of distinguishable playing pieces and dice are provided. Two players compete by alternately rolling the dice and by a combination of chance and skill seek to move a minimum of seven playing pieces across the board.

19 Claims, 5 Drawing Figures

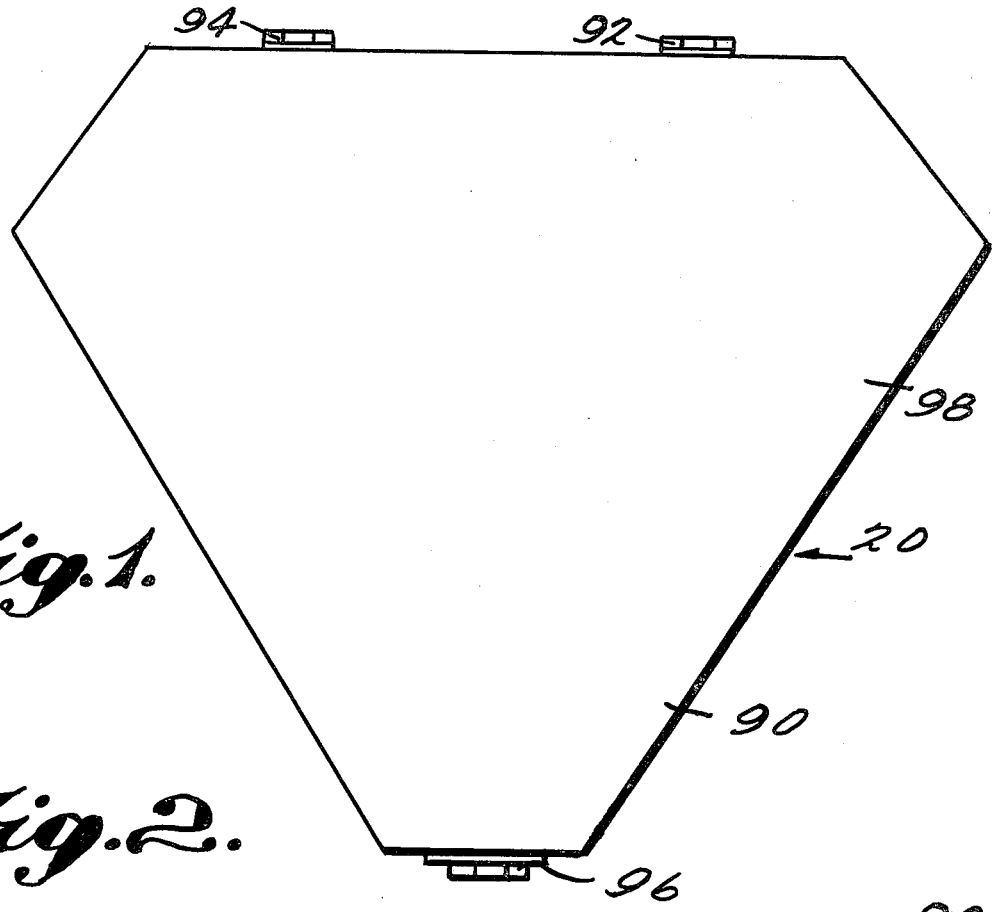
Fig. 1.
Fig. 2.
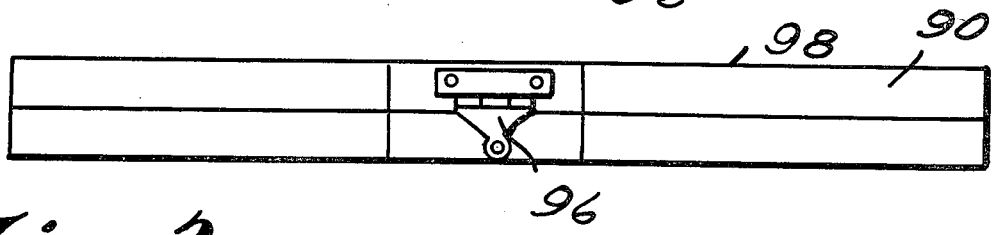
Fig. 3.
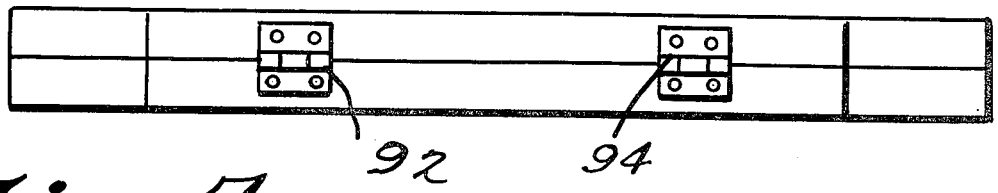
Fig. 4.
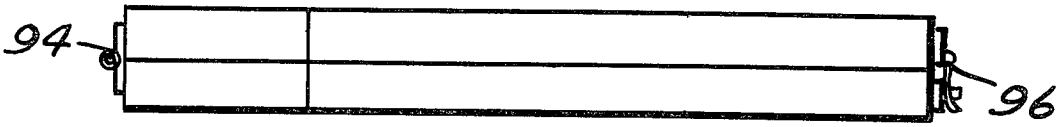

BOARD GAME APPARATUS

This invention relates to board game apparatus, and more particularly to a board game combining chance and skill.

It is an object of the present invention to provide a board game which uniquely combines chance and skill.

Another object is to provide a board game which is preferably played by two players and wherein strategic maneuvers can be plotted by the players in order to win the game.

Additional objects and advantages of the invention will be set forth in part in the description which follows, and in part will be obvious from the invention, or may be learned by practice of the invention. The objects and advantages are realized and attained by means of the instrumentalities and combinations particularly pointed out in the appended claims.

To achieve these and other objects, the present invention provides game apparatus including a game board defining a triangular playing surface; the playing surface defining a predetermined number of triangular areas formed by three groups of spaced parallel lines, each group of lines being parallel to a respective edge of the playing surface; the triangular areas defining a plurality of overlapping hexagons, each of the hexagons formed by six of the triangular areas positioned to have a common apex; predetermined ones of the triangular areas marked with a number from one through six; each of the hexagons having the six triangular areas within the hexagon marked with numbers one through six; plural sets of distinguishable playing pieces or chips, each player being assigned the pieces from one set; and means for indicating by chance a number from one through six for controlling movement of the playing pieces or chips on the game board in accordance with the rules of the game.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

FIG. 1 is a top plan view of the board game apparatus;

FIG. 2 is a front elevation view of the apparatus;

FIG. 3 is a rear elevation view of the apparatus;

FIG. 4 is a side elevation view of the apparatus; and

Figure 5:
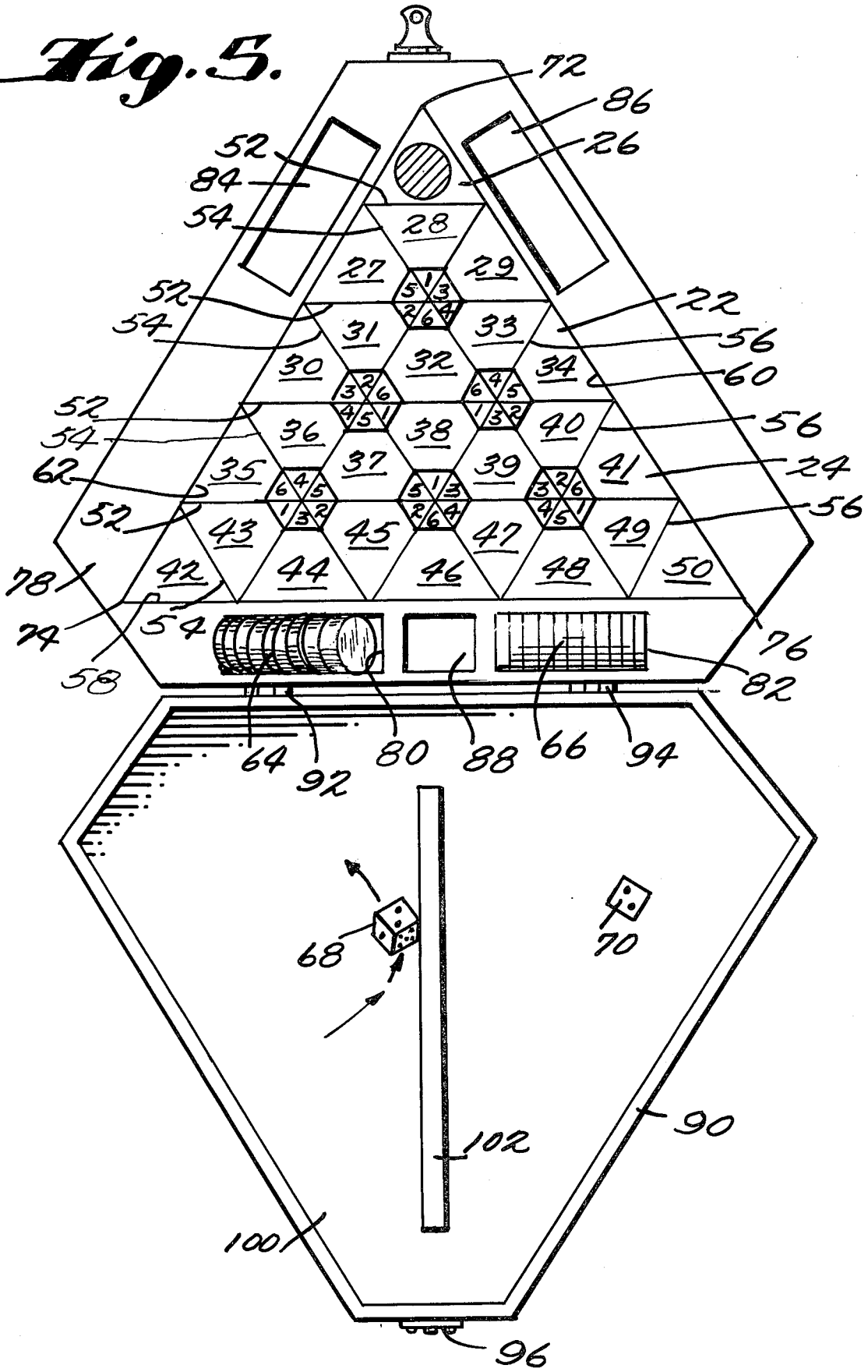
FIG. 5 is a top plan view of the apparatus showing the cover in an opened position.

With reference now to the drawings wherein like reference characters designate like or corresponding parts throughout the several views, there is shown game apparatus 20 in accordance with this invention. A game board 22 defines a triangular playing surface 24. The playing surface defines a predetermined number of triangular areas 26–50. The triangular areas are formed by three groups of spaced parallel lines 52, 54, and 56. The first group of spaced parallel lines 52 is positioned parallel to edge 58 of playing surface 24. The second group of spaced parallel lines 54 is positioned parallel to second edge 60 of the playing surface, and the third group of spaced parallel lines 56 is positioned parallel to third edge 62 of playing surface 24.

Triangular areas 26–50 define a plurality of overlapping hexagons, each of the hexagons formed by six of the triangular areas being positioned to have a common apex. For example, a first hexagon is formed by triangular areas 27, 28, 29, 31, 32 and 33. A second hexagon is formed by triangular areas 30, 31, 32, 36, 37 and 38. A third hexagon is formed by triangular areas 32, 33, 34, 38, 39 and 40. A fourth hexagon is formed by triangular areas 35, 36, 37, 43, 44 and 45. A fifth hexagon is formed by triangular areas 37, 38, 39, 45, 46 and 47. A sixth hexagon is formed by triangular areas 39, 40, 41, 47, 48 and 49.

As shown in FIG. 5, predetermined ones of the triangular areas are marked with a number from one through six, and each of the hexagons having the six triangular areas within the hexagon is marked with numbers one through six. Plural sets of distinguishable playing pieces 64, 66 are provided, and each player is assigned the pieces from one set. Means 68, 70 for indicating by chance a number from one through six are also provided for controlling movement of playing pieces 64, 66 on game board 22 in accordance with the rules of the game. Indicating means 68, 70 preferably include a first conventional die 68 and a second conventional, visually distinguishable, die 70.

Although the number of triangular areas provided within playing surface 24 may vary, the preferred embodiment illustrated provides twenty five triangular areas 26–50. In order to provide a visually appealing game board, each of triangular areas 26–50 and playing surface 24 are preferably equilateral triangles.

In the preferred embodiment of the game illustrated, three of the hexagons formed by predetermined ones of the triangular areas 26–50 are aligned along a first, or bottom, row. Two additional ones of the hexagons are aligned along a second, or middle, row, and one additional hexagon is positioned above and adjacent to the second row of hexagons.

In order to provide equal opportunities for each player to move across the board, it is important to number triangular areas 26–50 in an equitable and balanced manner. By so numbering the triangular areas, neither player is penalized, and each player has an equal opportunity of moving his pieces across the playing surface. For example, the numbers one through six within triangular areas 27, 28, 29, 31, 32 and 33 are located in the same relative positions with respect to each other as are the numbers one through six within triangular areas 37, 38, 39, 45, 46 and 47. More specifically, triangular areas 28 and 38 are designated by the numeral one. Triangular areas 29 and 39 are designated by the numeral three. Triangular areas 33 and 47 are designated by the numeral four. Triangular areas 32 and 46 are designated by the numeral six, and triangular areas 31 and 45 are designated by the numeral two. Similarly, the numbers within triangular areas 30, 31, 32, 36, 37 and 38 are located in the same relative positions with respect to each other as are the numbers within triangular areas 39, 40, 41, 47, 48 and 49. Likewise, the numbers within triangular areas 32, 33, 34, 38, 39 and 40 are located in the same relative positions with respect to each other as are the numbers within triangular areas 35, 36, 37, 43, 44 and 45.

All of the triangular areas, except triangular areas 26, 42 and 50, are arranged on playing surface 24 in a first set of four rows parallel with first edge 58 of the playing surface. For example, triangular areas 27, 28 and 29 are positioned in a first row parallel to edge 58. Triangular areas 30, 31, 32, 33 and 34 are arranged in a second row parallel with edge 58. Triangular areas 35, 36, 37, 38, 39, 40 and 41 are positioned in a third row parallel with first edge 58, and triangular areas 43, 44, 45, 46, 47, 48 and 49 are arranged in a fourth row parallel with edge 58.

All of the triangular areas, except triangular areas 26, 42 and 50, are arranged in a second set of four rows parallel with second edge 60 of playing surface 24. Likewise, all of the triangular area, except triangular areas 26, 42 and 50, are arranged in a third set of four rows parallel with third edge 62 of the playing surface.

Triangular area 26 at first apex 72 of playing surface 24 is an unnumbered "doubling" area. Triangular area 42 at a second apex 74 of playing surface 24 is an unnumbered "starting" area for a first player's pieces 64, and triangular area 50 at a third apex 76 of playing surface 24 is an unnumbered "starting" area for a second player's pieces 66.

Game apparatus 20 further includes a frame 78 attached in a conventional manner to playing surface 24. Frame 78 defines first and second playing piece holding compartments 80, 82 for storing playing pieces 64, 66, respectively, before the pieces are introduced into play onto playing surface 24. Frame 78 further defines third and fourth playing piece holding compartments 84, 86 for holding "cashed in" pieces 64, 66, respectively, after the pieces have been removed from play on the playing surface. Frame 78 also defines a fifth compartment 88 for holding dice 68, 70 when the dice are not in use.

A cover 90 is hingedly attached to frame 78 by means of hinges 92, 94, and fastening means 96 are attached to frame 78, and to cover 90 for fastening the cover into position over the frame and over playing surface 24 when the game is not in use. Cover 90 defines upper surface 98 and a lower surface 100, and a barrier member 102 is attached to lower surface 100 and is substantially centrally located on lower surface 100 for limiting movement of dice 68, 70 when the dice are rolled onto the lower surface by the players.

In order to distinguish the playing pieces or chips and the die of each player, the color of the first player's pieces 64 and of the first player's die 68 are preferably the same. Similarly, the color of the second player's pieces 66 and the second player's die 70 are the same as each other but they are different from the color of the first player's pieces and die.

In accordance with a preferred embodiment of the invention, each player is provided with eleven playing pieces 64, 66, but the number of pieces may vary depending upon variations in the rules of the game.

In the preferred embodiment of the game, two players compete against each other. However, it should be understood that more than two players can play the game and that a third or fourth set of playing pieces, for example, could be provided to enable more than two players to participate. In the preferred embodiment, the two players compete by alternately rolling dice 68, 70. Other embodiments of the game may include a single die which is shared by the players, and other indicating means may be provided which are controlled by chance for selecting a number from one through six. It should also be understood that although the triangular areas on the playing surface and the indicating means are described as having the numbers one through six associated therewith, it is contemplated that any group of six different numbers could be used on the triangular areas and on the indicating means.

In the preferred embodiment of the game, two players alternately roll the dice and plot strategic maneuvers in accordance with the game rules. The object of the game is to move a minimum of seven playing pieces or chips across the playing surface. When a player places one of his pieces onto the playing surface this is called "buying in". By rolling his die he then moves his playing piece across and up the board and finally off the board. When the player moves his piece off the playing surface this is called "cashing in". The first player to "cash in" seven of his playing pieces or chips is the winner of the game.

TO BEGIN (A) each of two players chooses a color (B) each player rolls their color die 68 or 70 and the highest number goes first (if numbers match-roll again)

(C) players then take turns rolling their die and moving their chips 64 or 66

(D) a turn is over when a player picks up his/her die from the board

MOVING CHIPS (A) chips are "bought in" one at a time per turn from compartments 80,82 by matching the number rolled on the die to the numbers in the hexagon nearest to the player's starting triangle 42 or 50.

example: player A rolls a four on his die and must place a single chip in the number four triangle of his opening hexagon. (If player A starts from triangle 42, he must place his first chip in triangle 36.)

(B) player B follows by rolling his die and moving in on his side of the board from triangle 50.

(C) player A then rolls again and may now;

(1) bring in a second chip (2) add or subtract the value of the die rolled to his first chip example: if player A rolls a two on his second turn, he can move his chip from number four triangle 36 to a number two or a number six triangle (four minus two equals two or four plus two equals six) provided that the number two or number six triangle is connected at any point to his presently held number four triangle 36 or (3) advance or "jump" a chip on the board one triangle level higher, provided;

(a) the triangle numbers to which the chip is "jumped" and from which the chip is to be moved match the number rolled on the die, and (b) the triangle to which the chip is "jumped" is not occupied by an opponent's chip.

example: player A has a chip on a bottom triangle level number one triangle and rolls another "one" on his next turn. He may move that chip to the number one triangle 38 in the middle of the second level—if open— thereby jumping because the triangles are not connected at any point.

note—the number one triangle 38 located in the center of the board (triangle level two) is the only triangle from which chips can move two levels higher. This is because the next higher number one triangle 28 is at the top of the board in triangle row/level four.

(D) chips can be "stacked" two high—one on top of another, and then moved as one chip (1) chips can be stacked or unstacked in any turn—in accordance with previous rules (2) stacked chips have the power to "bump" an opponent's chips, provided opponent's chip is single (doubles bump singles)

(a) when bumped, that chip is returned to opponent's starting triangle 42 or 50 and must be "bought" in to be played, if needed (E) each player must make a move on his/her turn even if it is not desirable to their strategy, unless it is absolutely impossible, then he must pass his turn

CASHING IN (A) chips must in the topmost hexagon triangles 27,28, 29, 31, 32 or 33 to be "cashed in"

(B) chip can be cashed in from single or double stacks but only one at a time—one chip per one roll of the die (C) "cashing in" is the same but opposite to "buying in"—the numbers on the die must match the number of the triangle from which the chip is to be "cashed in"

DOUBLING (A) either player may double the final game point score by placing a chip from their chip holding compartment 80 or 82 into the "doubling" triangle 26.

(1) this may be done prior to any turn but only alternately with opponent; no player may double twice-consecutively (a) chips used for doubling cannot be retrieved (b) either color doubles the final game point score for both players (c) there are eight possible doubling chips (eleven minus seven needed to play=four times two colors=eight)

(2) if either player cashes in seven chips before his opponent has any cashed in, the game score is automatically doubled (3) if a player refuses the doubling of the other player, he forfeits the game and loses by the total value of his chips on the board

SCORING (A) when either player has cashed in seven of his chips he wins . . .

(B) he then adds up the values of the remaining opponent's chips, disregarding any of his own chips that may still be on the board example: if player A gets seven of his chips off the board and cashed in first, and player B has only three chips off and five chips on the board, then the total number of those chips of player B are added up—suppose those chips are on triangles numbered two, one and four, and a double stack on a number five triangle; player B loses by five plus five plus four plus two plus one=seventeen points if doubled two X seventeen=thirty four points if redoubled two X two X seventeen=sixty eight points etc.

The invention in its broader aspects is not limited to the specific details shown and described, and departures may be made from such details without departing from the principles of the invention and without sacrificing its chief advantages.

What is claimed is:

1. Game apparatus, comprising:

a game board defining a triangular playing surface;

said playing surface defining a predetermined number of triangular areas formed by three groups of spaced parallel lines, each group of lines being parallel to a respective edge of said playing surface;

said triangular areas defining a plurality of overlapping hexagons, each of said hexagons formed by six of said triangular areas positioned to have a common apex;

each of said hexagons having each of said six triangular areas within said hexagons marked with one of six different numbers;

plural sets of distinguishable playing pieces, each player being assigned the pieces from one set; and means for indicating by chance one of said numbers for controlling movement of said playing pieces on said game board in accordance with the rules of said game apparatus.

2. Game apparatus as in claim 1 wherein twenty five of said triangular areas are provided within said playing surface.

3. Game apparatus as in claim 2 wherein six of said overlapping hexagons are defined by twenty two of said triangular areas.

4. Game apparatus as in claim 3 wherein three of said hexagons are aligned along a first row, two additional ones of said hexagons are aligned along a second row, and one additional hexagon is positioned adjacent said second row.

5. Game apparatus as in claim 4 wherein said numbered triangular areas within said additional hexagon are located in the same relative positions with respect to each other as are the numbered triangular areas in the middle one of said hexagons in said first row.

6. Game apparatus as in claim 5 wherein said numbered triangular areas within said one additional hexagon are located in the same relative positions with respect to each other as are the numbered triangular areas in the middle one of said hexagons in said first row.

7. Game apparatus as in claim 6 wherein said numbered triangular areas within said hexagon at the right end of said second row are located in the same relative positions with respect to each other as are the numbered triangular areas in said hexagon at the left end of said first row.

8. Game apparatus as in claim 7 wherein said twenty two triangular areas defining said hexagons are arranged in a first set of four rows parallel with a first edge of said playing surface, a second set of four rows parallel with a second edge of said playing surface, and a third set of four rows parallel with a third edge of said playing surface.

9. Game apparaus as in claim 8 wherein one of said triangular areas at a first apex of said playing surface is an unnumbered "doubling" area, one of said triangular areas at a second apex of said playing surface is an unnumbered "starting" area for a first player's pieces, and one of said triangular areas at a third apex of said playing surface is an unnumbered "starting" area for a second player's pieces.

10. Game apparatus as in claim 9 furthr including a frame attached to said playing surface, said frame defining first and second piece holding compartments for holding said playing pieces before said pieces are introduced into play onto said playing surface.

11. Game apparatus as in claim 10 wherein said frame further defines third and fourth piece holding compartments for holding said playing pieces after said pieces have been removed from play on said playing surface.

12. Game apparatus as in claim 11 wherein said frame further defines a fifth compartment for holding said indicating means.

13. Game apparatus as in claim 12 further including a cover hingedly attached to said frame, and fastening means attached to said frame and to said cover for fastening said cover into position over said frame and over said playing surface when the game is not in use.

14. Game apparatus as in claim 13 wherein said indicating means include a first die and a second visually distinguishable die.

15. Game apparatus as in claim 14 wherein said cover defines an upper surface and a lower surface and further includes a barrier member attached to said lower surface and substantially centrally located on said lower surface for limiting movement of said dice when they are rolled onto said lower surface by the players.

16. Game apparatus as in claim 15 wherein the color of said first player's pieces and said first player's die are the same, and wherein the color of said second player's pieces and said second player's die are the same as each other but different from the color of said first player's pieces and die.

17. Game apparatus as in claim 16 wherein said first player's pieces are eleven in number, and wherein said second player's pieces are eleven in number.

18. Game apparatus as in claim 17 wherein said triangular playing surface and said triangular areas are equilateral triangles.

19. Game apparatus as in claim 18 wherein said six different numbers are the numbers one through six.

* * * * *

UNITED STATES PATENT AND TRADEMARK OFFICE

CERTIFICATE OF CORRECTION

PATENT NO. : 4,421,314

DATED : December 20, 1983

INVENTOR(S) : Roger Stancill

It is certified that error appears in the above-identified patent and that said Letters Patent are hereby corrected as shown below:

Column 6, line 4, change "hexagons" to --hexagon--, line 24, between "said" and "additional" insert --one--.

line 54, change "furthr" to --further--

Signed and Sealed this

*Thirteenth* Day of *March 1984*

[SEAL]

*Attest:*

GERALD J. MOSSINGHOFF

*Attesting Officer*

*Commissioner of Patents and Trademarks*